US006572337B1

(12) United States Patent
Herron

(10) Patent No.: US 6,572,337 B1
(45) Date of Patent: Jun. 3, 2003

(54) TURBINE ROTOR TORQUE TRANSMISSION

(75) Inventor: William L. Herron, Greenville, SC (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/451,168

(22) Filed: Nov. 30, 1999

(51) Int. Cl.[7] ..... B63H 1/00
(52) U.S. Cl. ..... 416/198 A
(58) Field of Search ..... 416/198 R, 198 A

(56) References Cited

U.S. PATENT DOCUMENTS

| | | | | | |
|---|---|---|---|---|---|
| 1,107,238 | A | * | 8/1914 | Kieser | 416/198 A |
| 2,928,649 | A | * | 3/1960 | Lombard et al. | 416/198 R |
| 3,916,495 | A | * | 11/1975 | Klassen et al. | 416/198 A X |
| 3,981,609 | A | * | 9/1976 | Koenig | 415/117 |
| 4,123,199 | A | * | 10/1978 | Shimizu et al. | 416/198 A X |
| 4,477,227 | A | * | 10/1984 | Klufas | 416/198 A |
| 4,581,816 | A | * | 4/1986 | Klufas et al. | 416/198 A X |
| 5,685,158 | A | | 11/1997 | Lenahan et al. | |
| 5,796,202 | A | | 8/1998 | Herron et al. | |

FOREIGN PATENT DOCUMENTS

| | | | | |
|---|---|---|---|---|
| CA | 458863 | * | 8/1949 | 416/198 A |
| DE | 2402218 | * | 8/1974 | 416/198 A |
| GB | 2235734 | * | 3/1991 | 416/198 A |
| JP | 60-128904 | * | 7/1985 | 416/198 A |

* cited by examiner

*Primary Examiner*—John E. Ryznic
(74) *Attorney, Agent, or Firm*—Nixon & Vanderhye

(57) ABSTRACT

An axial torque coupling between a pair of adjacent rotating machine wheels comprising a first wheel having a first plurality of axially extending knuckles, the first plurality of knuckles spaced circumferentially in an annular array with first slots therebetween, and a second wheel having a second plurality of axially extending knuckles, the second plurality of knuckles spaced circumferentially in an annular array with second slots therebetween; and wherein the first plurality of knuckles are received in the second slots and the second plurality of knuckles are received in the first slots, each of the first plurality of knuckles engaging an adjacent one of the second plurality of knuckles only on a single radial surface.

15 Claims, 3 Drawing Sheets

TURBINE ROTOR TORQUE TRANSMISSION

BACKGROUND OF THE INVENTION

Some gas turbine and compressor rotors have historically been of a "stacked" construction, where a series of individual wheels and shafts are held together with sets of bolts extending axially through the stack. Tension in the bolts squeezes the wheels and shafts together, and friction forces then allow torque to be transmitted across the interface, without relying on shear strength of the bolts. Significant variations in flange face friction factors, bolt assembly, and operation of the machine can result in substantial variation in the torque-carrying capabilities of the rotors. Continued operation at elevated temperatures can result in stress relaxation of the bolts, further degrading the torque capacity of the rotor.

Limits to the torque capability of friction drive machines are being approached with the higher temperature operation associated with newer, high compression ratio and high firing temperature machines. Further, operation with low heating value synthetic fuels ("process" fuels) increases the feasible output from a given machine, without any changes to the rotor construction. If the torque requirements on the rotor exceed the actual capabilities, wheels will slip relative to each other, typically resulting in a corkscrewed, or "cammed" rotor. Unbalance resulting from this will cause the machine to shut down due to unacceptable vibrations, and require time consuming and costly rotor teardown and reassembly.

A number of different approaches in torque transmission, including friction, bolt shear, radial teeth combined with bolts, gear teeth on wheel faces combined with bolts, etc. have been applied in industrial gas turbines or other rotary machines but all have inherent disadvantages.

BRIEF SUMMARY OF THE INVENTION

This invention provides a system for positive torque transmission between rotor stages (both turbine and compressor stages are contemplated), to enhance the torque carrying capabilities of industrial gas turbines and to reduce the variability of this capability. Introduction of such a system will also reduce the need for high compressive loads in the rotor stack, thus allowing reduction in bolt tension, and/or bolt diameter. This, in turn will result in increased bolt design margin and reduced dead loads to the rotor and a net stress or weight reduction.

In an exemplary embodiment, the invention consists of a series of axially extending "knuckles" machined in the adjacent wheels to be coupled. These knuckles interlock across a flange face. The knuckles themselves have no radial or axial interference, and are therefore used in concert with a rabbet joint that maintains radial concentricity of the rotor. Axial bolts are still required to hold the structure together, but since the knuckles carry circumferential loads (torque), high compressive loads are not required and bolt stresses or diameters may be reduced from current practice.

Accordingly, in its broader aspects, the invention relates to an axial torque coupling between a pair of adjacent rotating machine wheels comprising a first wheel having a first plurality of axially extending knuckles, the first plurality of knuckles spaced circumferentially in an annular array about the first face with first slots therebetween, and a second wheel having a second plurality of axially extending knuckles, the second plurality of knuckles spaced circumferentially in an annular array with second slots therebetween; and wherein the first plurality of knuckles are received in the second slots and the second plurality of knuckles are received in the first slots, each of the first plurality of knuckles engaging an adjacent one of the second plurality of knuckles only on a single radial surface.

DETAILED DESCRIPTION OF THE INVENTION

Figure 1:
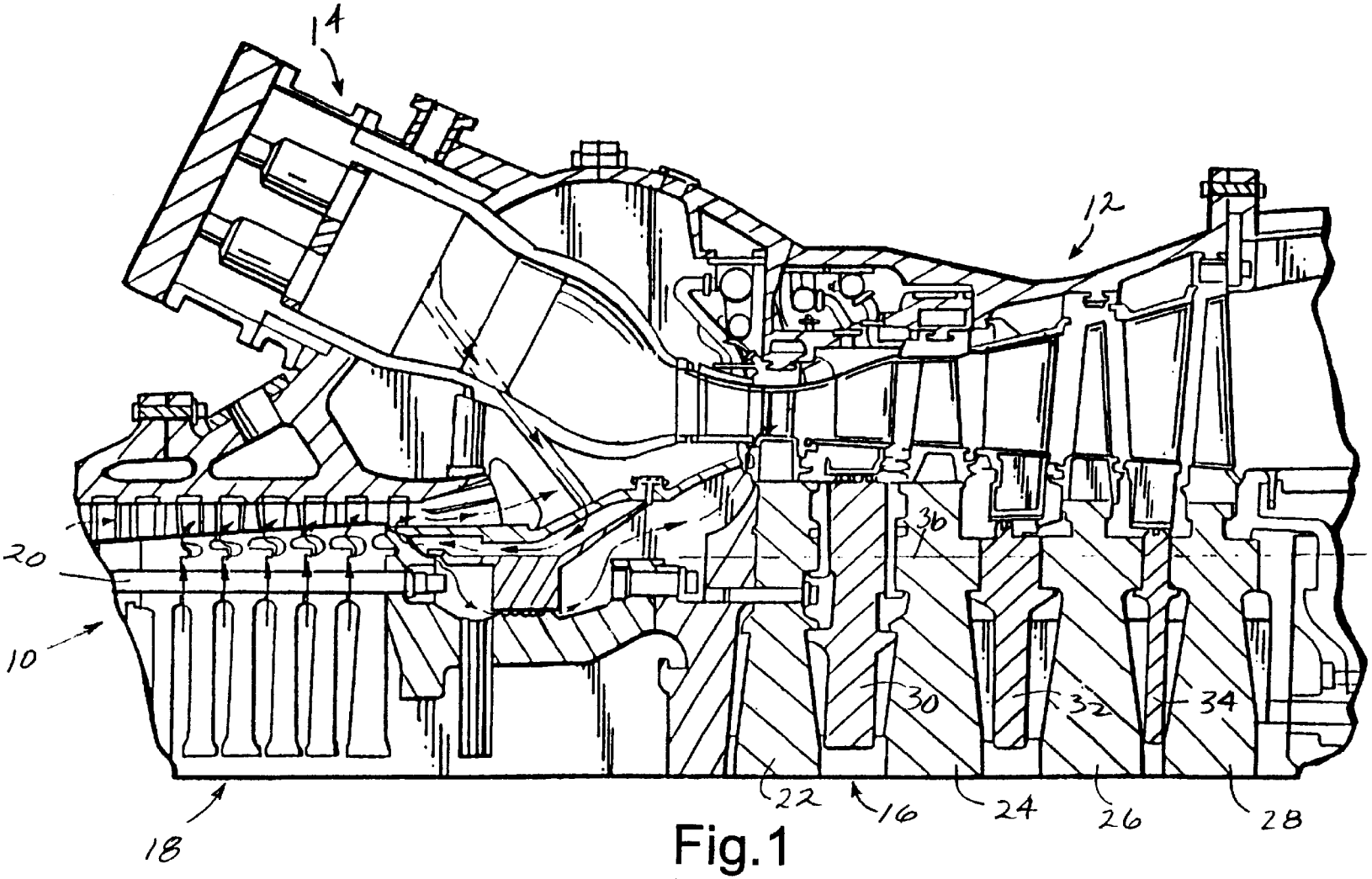
Fig.1 (PRIOR ART)
FIG. 1 is a partial section of a conventional axial flow compressor and gas turbine.

FIG. 1 illustrates generally the environment of the invention. Specifically, the Figure shows an axial flow compressor 10 and a gas turbine 12. Air from the compressor 10 is discharged to an array of conventional combustors 14 located circumferentially about the rotor 16. Only the final five stages at the aft end of the compressor are shown, and indicated generally by reference numeral 18. An axially extending tie bolt 20 is partially shown, and several such bolts arranged circumferentially about the rotor hold the compressor stages or wheels 18 together.

Similarly, the gas turbine stages or wheels 22, 24, 26 and 28 are sandwiched by spacer wheels 30, 32 and 34 and held together by a similar array of tie bolts (not shown), one of which has an axis 36.

Figure 2:
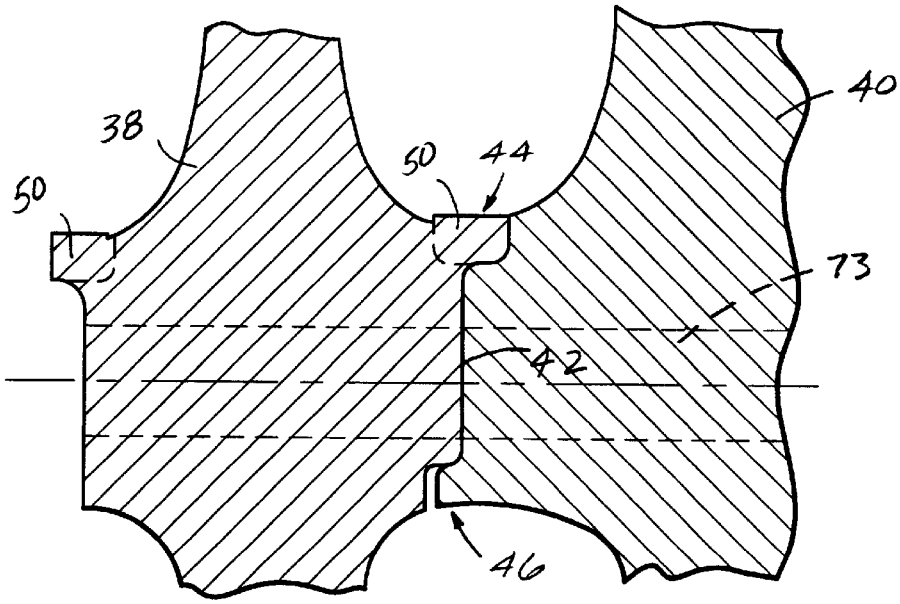
FIG. 2 is a partial side section of a torque drive between rotor sections in accordance with the invention.
Figure 3:
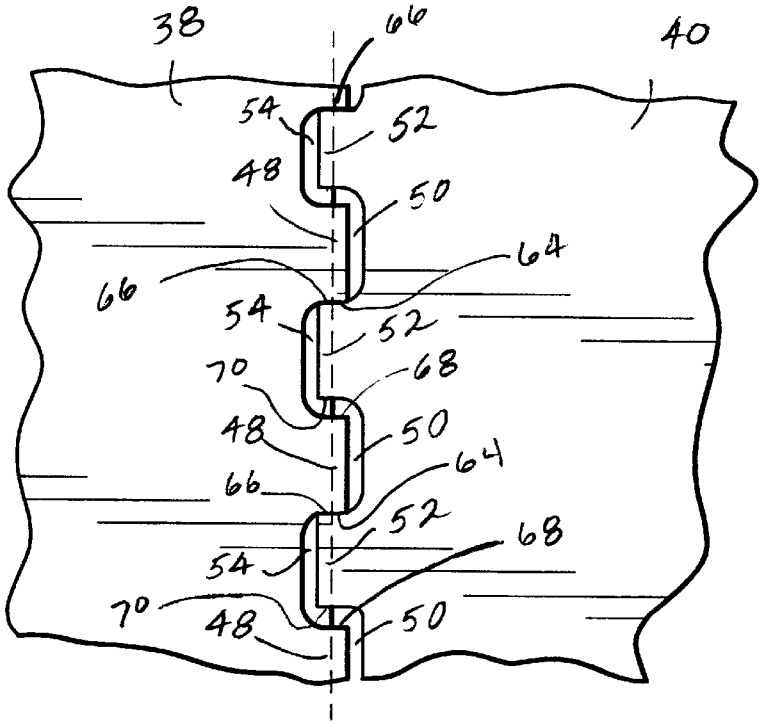
FIG. 3 is as partial plan view of the drive illustrated in FIG. 2.

FIGS. 2 and 3 show the "knuckle" feature in accordance with the invention. Specifically, two adjacent wheels 38 and 40 are engaged at an interface along a surface 42 extending in a radial direction between the radially outer torque drive arrangement at 44 and the radially inner axial centering rabbet joint at 46. The torque drive arrangement comprises a circumferentially spaced array of interengaged teeth or knuckles where the knuckles 48 formed in wheel 38 are received within the spaces 50 between adjacent knuckles 52 on wheel 40. Similarly, knuckles 52 formed on wheel 40 are received within spaces 54 between adjacent knuckles 48 on wheel 38. Since the knuckles 48 and 52 and spaces 50 and 54 are identical, only wheel 38 will be described in detail.

Figure 4:
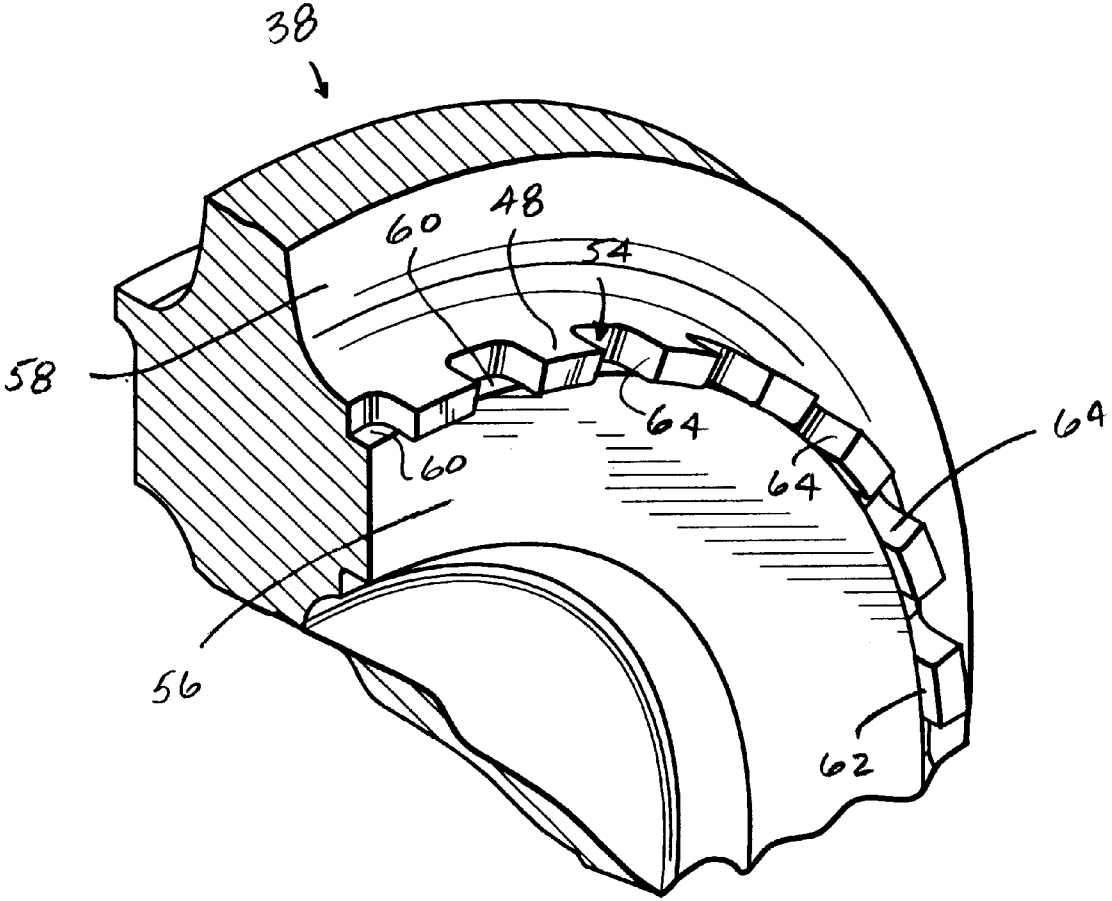
FIG. 4 is a partial perspective of the drive shown in FIGS. 2 and 3.

With reference also to FIG. 4, it will be seen that knuckles 48 project axially from the wheel 38 in an annular array. The radially inner surface 56 (below the knuckles 48) projects axially beyond the radially outer surface 58 (above knuckles 48), creating axial ledges or flanges 60 circumferentially between the knuckles, flush with the radially inner surface 62 of the latter. The knuckles 52 on wheel 40 will not, however, seat on the surfaces 60. In fact, the knuckles 48 and 52 have no radial or axial interference, and engage only along opposed circumferential surfaces 64, 66 (that lie in a radial plane) in the direction of rotation of the rotor, leaving opposed surfaces 68, 70 at the opposite side of the knuckles slightly spaced from each other. In other words, the axial length of spaces 50 and 54 is greater than the axial length of knuckles 48 and 52 to prevent axial interference. Similarly, the slots or spaces 50, 54 are cut slightly deeper radially than the radially inner surfaces of the knuckles 48, 52 to prevent radial interference between the wheels. The rabbet joint shown at 46 will provide a radial interference/centering function to insure that all of the wheels are on the center axis of the rotor.

The sides of the spaces or slots 50, 54 and knuckles 48, 50 are machined radially in the wheel, so that they may slide relative to each other, accounting for differential radial growth of the adjacent wheels. This differential growth may occur due to mechanical or thermal loads. Since this feature is not used for radial alignment of the rotor, the wear due to this relative motion should be minimal (and less than that experienced on conventional couplings).

The number of slots/knuckles must be an integral multiple of the number of tie bolt holes 72 (for tie bolts shown in FIG. 2 in phantom at 73), to allow assembly of the rotor with any clock orientation as required for rotor balance. The actual number may be set to ensure adequate shear strength of the knuckles to carry the required rotor torque. Note also that the circumferential orientation of the slots/knuckles must be controlled relative to the bolt hole orientation.

Because the slots or spaces 50, 54 are machined slightly wider than the knuckles 48, 52, to avoid circumferential slip of the wheels during initial machine startup the assembly procedure should call for circumferential positioning of the wheels, and twisting each wheel in the direction of operationally applied torque as it is inserted on the adjacent wheel. In this way, the only dimension of the slots and knuckles that needs to be tightly controlled is the orientation of the loaded faces relative to the bolt hole position (slot depth, height, and width are much less critical to control). It is contemplated that for a five foot diameter wheel, the knuckles may have an axial length of from ½ to about 1 inch and a circumferential width of about 3 inches. These dimensions may vary, however, depending on specific applications.

The invention may be applied at each interface between adjacent wheels in both compressors and turbines. On the other hand, the interfaces at the back end of the compressor and forward end of the turbine may especially benefit from the torque drive device of the invention. For example, in one exemplary embodiment, the aft 5 stages of an 18 stage compressor and at least stages 2 and 3 of the turbine may incorporate the invention. In addition, the "marriage joint" where the compressor joins with the turbine, may be similarly outfitted.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An axial torque coupling between a pair of adjacent rotating machine wheels comprising a first wheel having a first plurality of axially extending knuckles, said first plurality of knuckles spaced circumferentially in an annular array about said first face with first slots therebetween, and a second wheel having a second plurality of axially extending knuckles, said second plurality of knuckles spaced circumferentially in an annular array with second slots therebetween; and wherein said first plurality of knuckles are received in said second slots and said second plurality of knuckles are received in said first slots, each of said first plurality of knuckles engaging only one of said second plurality of knuckles.

2. The axial torque coupling of claim 1 wherein each of said first and second wheels has radially inner and outer surfaces wherein said radially inner surface projects axially beyond said radially outer surface.

3. The axial torque coupling of claim 2 wherein an axial surface separating said radially inner and radially outer surfaces lies flush with an inner surface of each of said knuckles and thus forms bottoms of said slots.

4. The axial torque coupling of claim 1 wherein said first and second wheels comprise first and second stages of a gas turbine.

5. The axial torque coupling of claim 1 wherein said first and second wheels comprise adjacent stages of a compressor.

6. The axial torque coupling of claim 1 wherein said first and second plurality of knuckles are axially and radially spaced from each other.

7. The axial torque coupling of claim 1 wherein each of said first and second plurality of knuckles is formed with a pair of surfaces lying in radial planes, and wherein each of said first and second plurality of knuckles is engaged only along one of said pair of surfaces.

8. An axial torque coupling between a pair of adjacent rotating machine wheels comprising a first wheel having a first plurality of axially extending knuckles, said first plurality of knuckles spaced circumferentially in an annular array about said first face with first slots therebetween, and a second wheel having a second plurality of axially extending knuckles, said second plurality of knuckles spaced circumferentially in an annular array with second slots therebetween; and wherein said first plurality of knuckles are received in said second slots and said second plurality of knuckles are received in said first slots, each of said first plurality of knuckles engaging only one of said second plurality of knuckles; and further including a rabbet joint between said first and second wheels.

9. The axial torque coupling of claim 8 wherein said first and second plurality of knuckles are located radially outwardly of said rabbet joint.

10. The axial torque coupling of claim 9 and further comprising a plurality of tie bolts extending axially between at least said first and second wheels.

11. The axial torque coupling of claim 10 wherein said plurality of tie bolts are located radially between said first and second plurality of knuckles and said rabbet joint.

12. A turbine having multiple compressor stages and multiple turbine stages, and wherein between at least two adjacent compressor stages and between at least two adjacent turbine stages there is an axial torque coupling including interengaging axially extending teeth, each tooth having a pair of surfaces lying in circumferentially spaced radial planes, wherein each tooth is engaged along only one of said pair of surfaces.

13. The axial torque coupling of claim 12 wherein said first and second plurality of knuckles are axially and radially spaced from each other.

14. A turbine having multiple compressor stages and multiple turbine stages, and wherein between at least two adjacent compressor stages and between at least two adjacent turbine stages there is an axial torque coupling including interengaging axially extending teeth, each tooth having a pair of surfaces lying in circumferentially spaced radial planes, wherein each tooth is engaged along only one of said pair of surfaces; and further including a rabbet joint between said at least two compressor stages and between said at least two turbine stages.

15. The turbine of claim 14 and further comprising respective sets of tie bolts for holding said at least two adjacent compressor stages and said at least two adjacent turbine stages together in an axial direction.

* * * * *

UNITED STATES PATENT AND TRADEMARK OFFICE

CERTIFICATE OF CORRECTION

PATENT NO. : 6,572,337 B1
APPLICATION NO. : 09/451168
DATED : June 3, 2003
INVENTOR(S) : Herron It is certified that error appears in the above-identified patent and that said Letters Patent is hereby corrected as shown below:

Column 1, line 2, below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*